US008204693B2

(12) United States Patent
Briers et al.

(10) Patent No.: US 8,204,693 B2
(45) Date of Patent: Jun. 19, 2012

(54) METHOD FOR VIRTUAL METERING OF INJECTION WELLS AND ALLOCATION AND CONTROL OF MULTI-ZONAL INJECTION WELLS

(75) Inventors: Jan Jozef Maria Briers, Rijswijk (NL); Keat-Choon Goh, Rijswijk (NL); Christophe Lauwerys, Leuven (BE); Peter Stefaan Lutgard Van Overschee, Leuven (BE)

(73) Assignee: Shell Oil Company, Houston, TX (US)

( * ) Notice: Subject to any disclaimer, the term of this patent is extended or adjusted under 35 U.S.C. 154(b) by 255 days.

(21) Appl. No.: 12/673,013

(22) PCT Filed: Aug. 15, 2008

(86) PCT No.: PCT/EP2008/060748

§ 371 (c)(1),
(2), (4) Date: Feb. 11, 2010

(87) PCT Pub. No.: WO2009/024544

PCT Pub. Date: Feb. 26, 2009

(65) Prior Publication Data

US 2011/0301851 A1 Dec. 8, 2011

(30) Foreign Application Priority Data

Aug. 17, 2007 (EP) ..... 07114567

(51) Int. Cl.
*G01F 9/00* (2006.01)

(52) U.S. Cl. ..... 702/12; 702/45

(58) Field of Classification Search ..... 702/12, 702/45

See application file for complete search history.

(56) References Cited

U.S. PATENT DOCUMENTS 4,192,182 A * 3/1980 Sylvester ..... 73/152.39
4,374,544 A * 2/1983 Westerman et al. ..... 166/252.4
4,523,459 A * 6/1985 Hastings ..... 73/152.39
4,676,313 A * 6/1987 Rinaldi ..... 166/252.1

(Continued)

FOREIGN PATENT DOCUMENTS

WO WO 2006/048418 A1 * 5/2006
WO WO2006048418 5/2006
WO WO2007116006 10/2007
WO WO2007116008 10/2007

OTHER PUBLICATIONS

Belsim: Belsim Data validation technology (Online) Dec. 9, 2004, pp. 1-10—XP002468771—http://www.touchbriefings.com/pdf/1195/Belsim_tech.pdf.

(Continued)

*Primary Examiner* — Sujoy Kundu
*Assistant Examiner* — Regis Betsch

(57) ABSTRACT

A method for virtually metering flow rates in a cluster of injection wells comprises: closing each well in and performing a dynamically disturbed injection test (DDIT) on it, during which the injection rate to the well is varied while the flow rate in the header conduit assembly (HCA) and one or more injection well variables of the test well and the other wells are monitored, and the other wells are controlled so that their tubing head pressures or flow meter readings remain constant; for each tested well deriving a model providing a correlation between variations of the fluid flowrate attributable to the test well and variations of the well variables monitored during each DDIT; injecting fluid into each well while monitoring a flow pattern in the HCA and one or more well variables; calculating an estimated injection rate at each well basis on flow pattern, well variables and the model.

15 Claims, 7 Drawing Sheets

U.S. PATENT DOCUMENTS

| | | | | |
|---|---|---|---|---|
| 4,721,158 | A * | 1/1988 | Merritt et al. | 166/250.01 |
| 6,464,011 | B2 * | 10/2002 | Tubel | 166/313 |
| 6,561,041 | B1 * | 5/2003 | Eck | 73/861.04 |
| 6,615,917 | B2 * | 9/2003 | Bussear et al. | 166/250.15 |
| 6,980,940 | B1 * | 12/2005 | Gurpinar et al. | 703/10 |
| 2007/0295501 | A1 * | 12/2007 | Poulisse | 166/250.01 |

OTHER PUBLICATIONS

Juan Carlos Mantecon—The Virtual Well: Guidelines for the Application of Dynamic Simulation to optimize well operations, life cycle design and production—Society of Petroleum Engineers vol. SPE No. 109829-XP002468774.

H Poulisse et al—Continuous well prosecution flow monitoring and surveillance Society of Petroleum Engineers vol. SPE No. 99963-XP002468772.

M Studner et al—Production performance monitoring workflow Society of Petroleum engineers vol. SPE No. 103757—XP002468773.

* cited by examiner

Injection from Fluid Source to a Cluster of Wells

Injecton to Multiple Zones in a "Daisy Chain" in a Multizone Well

Injection to Multiple Zones with Concentric Tubing in a Multizone Well

Data Driven Virtual Injection Metering

Data Driven Dynamic Reconciliation

Data Flow for
Multizonal Well Injection Surveillance

Zonal Pressure & injection Management

METHOD FOR VIRTUAL METERING OF INJECTION WELLS AND ALLOCATION AND CONTROL OF MULTI-ZONAL INJECTION WELLS

PRIORITY CLAIM

The present application claims priority of PCI Application EP2008/060748, filed 15 Aug. 2008, which claims priority to European Patent Application No. 07114567.6 filed 17 Aug. 2007.

BACKGROUND OF THE INVENTION

The invention relates to a method for providing virtual and backup metering, surveillance and injection control of a cluster of injection wells and/or injection wells with multiple zones and/or branches, used for the injection of fluids into underground reservoirs.

In many oil production operations, where oil is produced from underground reservoirs, various fluids are injected into the reservoirs to increase recovery of oil. The injected fluids increase oil recovery by providing increased pressure support for the extraction of oil, or by displacing the oil toward the wells. Typical fluids injected into the reservoirs for IOR operations include water or hydrocarbon gas. In the state of the art for Improved Oil Recovery (IOR) operations, each injection well may furthermore have multiple injection zones or branches for which the injection flow into each zone and/or branch is to be monitored and controlled.

Additionally, in many oil production operations, effluents are produced as by-products of the oil and gas extraction process, and such waste effluents are disposed off by injection into reservoirs via disposal wells. Typically, the effluents disposed into underground reservoirs include excess produced water or carbon dioxide. The reliability of such disposal operations is often critical for the simultaneous oil and gas production process. Similarly, injection wells are also found in underground storage operations in which hydrocarbon gas is stored in underground locations.

In the above cases, the process of injection into underground formations requires surveillance and control to monitor the amount of the effluents injected and to adjust the injected flows consistent with the objectives of the process, for example to ensure a uniform sweep of oil bearing formations. Furthermore, surveillance is required to ensure detect changes in the receptiveness of the well and reservoir to continued injection, either due to injection well impairment, fractures in the reservoir matrix or due to increased reservoir pressures.

In conventional practice, injection wells are often equipped at the surface with single phase flow meters and pressure measurements. However, flowmeters are susceptible to drift in accuracy or of complete failure. For example, water flow meters tend to scale up. It is not abnormal in the field for the sum of individual water meter measurements to be very significantly different from the measurement of the total water flow before distribution to the individual wells. In the case of meter failures, a computer algorithm or "Virtual Meter" may be generated to provide an alternative substitute estimates for the injected flows. Similarly, it is desirable to provide a method for validation and reconciliation of the injection flows or estimates. In additional to the foregoing, in the case of injection wells with multiple injection zones and/or branches, it is in general problematic to provide subsurface flow meters to measure injection flows into individual zones and/or branches. In such cases, virtual flow meters may be applied for tracking of injection into each individual zone or branch.

Applicant's International patent application PCT/EP2005/055680, filed on 1 Nov. 2005, "Method and system for determining the contributions of individual wells to the production of a cluster of wells" discloses a method and system named and hereafter referred to as "Production Universe Real Time Monitoring" (PU RTM). The PU RTM method allows accurate real time estimation (virtual metering) of the multiphase oil, water and gas contributions of individual wells to the total commingled production of a cluster of crude oil, gas and/or other fluid production wells, based on real time well measurement data such as well pressures, in combination with well models derived from data from a shared well testing facility and updated regularly using reconciliation based on comparing the dynamics of the well estimates and of the commingled production data.

Applicant's International patent application PCT/EP2007/053345, filed on 5 Apr. 2007, "METHOD FOR DETERMINING THE CONTRIBUTIONS OF INDIVIDUAL WELLS AND/OR WELL SEGMENTS TO THE PRODUCTION OF A CLUSTER OF WELLS AND/OR WELL SEGMENTS" discloses a method and system named and hereafter referred to as "PU RTM DDPT". The PU RTM DDPT, used in association with the method of PU RTM, allows the accurate real time estimation of the contributions of individual wells, using well models based on data derived solely from the metering of commingled production flows and the dynamic variation of flow therein, without the use of a well testing facility. The PU RTM DDPT method is specifically applicable and necessary for production wells with multiple zones and/or branches, and wells without a shared well test facility, such as subsea wells sharing a single pipeline to surface production facilities. Further, the Applicant's International patent application PCT/EP2007/053348, filed on 5 Apr. 2007, "METHOD AND SYSTEM FOR OPTIMISING THE PRODUCTION OF A CLUSTER OF WELLS" discloses a method and system named and hereafter referred to as "PU RTO". The PU RTO, used in association with the method of PU RTM, provides a method and system to optimise the day to day production of a cluster of wells on the basis of an estimation of the contributions of individual wells to the continuously measured commingled production of the cluster of wells, tailored to the particular constraints and requirements of the oil and gas production environment.

It is an object of the present invention to extend the concepts of the above inventions to provide a method, which supports the backup metering and reconciliation of flows into injection wells, including injection flows into individual zones and/or branches of injection wells, and the control of downhole pressures in, and of injection rates into, individual zones and/or branches of suitably equipped injection wells. In particular, the PU RTM DDPT method of characterizing wells which do not have access to shared well testing facilities is applied to injection wells, as such wells do not have access to shared well testing facilities.

It may also be noted that the relevant prior art includes approaches which use conventional thermodynamic and fluid mechanics models from chemical engineering or physics to track flows, for example the reference "Belsim Data Validation Technology" dated 9 Dec. 2004, retrieved from the internet at www.touchbriefings.com/pdf/1195/Belsim_tech.pdf. Such methods have the difficulty that technically complex a priori models need to be set up. This approach is thereafter difficult to sustain in practice as various physical and fluid parameters change. These approaches are also usually based on daily totals and do not incorporate the pattern reconciliation of the PU RTM invention. The present invention is based on the practical use of minute by minute actual field data from simple field testing, building from the PU RTM DDPT approach, to construct and regularly systematically update models for the backup metering and for the reconciliation of injection flows.

SUMMARY OF INVENTION

In accordance with the invention there is provided a method for determining fluid flow rates in a cluster of fluid injection wells which are connected to a collective fluid supply header conduit assembly, comprising:

a) monitoring fluid flow, and optionally pressure, in the collective injection fluid supply header conduit assembly by means of a header flow meter, and optionally a header pressure gauge;

b) monitoring one or more injection well variables in or near each injection well by means of well variable monitoring equipment arranged in or near each injection well, including a tubing head pressure gauge in a fluid injection tubing in or near each injection well, and optionally a surface or downhole flow meter, an injection choke valve position indicator, a differential pressure gauge across a flow restriction, a wellhead flowline pressure gauge and/or a downhole tubing pressure gauge;

c) sequentially testing each of the injection wells of the cluster by performing a dynamically disturbed injection well test (DDIT) on the tested well, during which test the well is first closed and is then gradually opened in a sequence of steps so that the injection rate to the tested well is varied over a range of flows whilst the fluid flowrate and optionally pressure in the header conduit assembly are monitored in accordance with step a and one or more injection well variables of the well under test and of the other wells in the cluster are monitored in accordance with step b, and controlling the other wells in the cluster such as to cause their tubing head pressures or flow meter readings to be approximately constant for the duration of the test;

d) deriving from step c a well injection estimation model for each tested well, which model provides a correlation between variations of the fluid flowrate attributable to the well under consideration, and optionally pressure, in the header conduit assembly measured in accordance with step a, and variations of one or more well variables monitored in accordance with step b during each dynamically disturbed injection well test;

e) injecting fluid through the header conduit assembly into the cluster of wells whilst a dynamic fluid flow pattern, and optionally a dynamic pressure pattern, in the header conduit assembly is monitored in accordance with step a and one or more well variables of each injection well are monitored in accordance with step b; and f) calculating an estimated injection rate at each well on the basis of the well variables monitored in accordance with step e and the well injection estimation model derived in accordance with step d; and wherein the method further includes a dynamic reconciliation process comprising the steps of:

g) calculating an estimated dynamic flow pattern in the supply header conduit assembly over a selected period of time by accumulating the estimated injection flows of each of the wells made in accordance with step f over the selected period of time; and h) iteratively adjusting for each injection well the well injection estimation model for that well until across the selected period of time the accumulated estimated dynamic flow pattern calculated in accordance with step g substantially matches with the monitored header dynamic fluid flow pattern monitored in accordance with step e.

i) repeating steps g and h from time to time.

The well variable monitoring equipment may not comprise, or comprise one or more possibly defective or inaccurate, surface or downhole flowmeters at one or more injection wells and a virtual flow meter is generated in step f, and then refined via the dynamic reconciliation process as described hereinbefore.

At least one injection well may be a multizone injection well with multiple zones and/or branches that are each connected to a main wellbore at a zonal or branch connection point which is provided with an Inflow Control Valve (ICV), means for estimating the current position of the ICV, and one or more downhole pressure gauges located upstream and/or downstream of the ICV for monitoring the fluid pressure upstream and/or downstream of the ICV, and the method further comprises:

j) performing a deliberately disturbed zonal injection test (DDZIT) during which the flowrate of the fluid injected into each zone of the tested multizone well is varied by sequentially changing the opening of each ICV;

k) monitoring during step j injection well variables including the surface flowrate and pressure of the fluid injected into the tested multizone well, the position of each ICV and the fluid pressure upstream and/or downstream of each ICV;

l) deriving from steps j and k a zonal injection estimation model for each of the tested zones, which model provides a correlation between the monitored injection variables and an associated fluid injection rate into each of the zones of the multizone well;

m) calculating an estimated injection rate at each zone on the basis of the surface and zonal variables monitored in accordance with step k and the zonal injection estimation model derived in accordance with step l; and n) steps j, k, l and m are repeated from time to time.

As applicable to the multizone wells, the method of may further comprise the steps of:

r) defining an operational injection target for each of the zones, consisting of a target to be optimised and various Constraints on the zonal injection flows and well bore pressures or other variables measured in step k; and s) making from the estimates of step m adjustments to settings of zonal ICVs such that the optimisation target of step r is approached.

The method according to the invention is in this specification and the claims also referred to as "PU Inj". These and other features, aspects and advantages of the PU Inj method according to the invention are described in the accompanying claims, abstract and the following detailed description of depicted embodiments in which reference is made to the accompanying drawings.

BRIEF DESCRIPTION OF THE DRAWINGS

The invention will be described by way of example in more detail with reference to the accompanying drawings in which.

DETAILED DESCRIPTION OF PREFERRED EMBODIMENTS OF THE INVENTION

Figure 1:
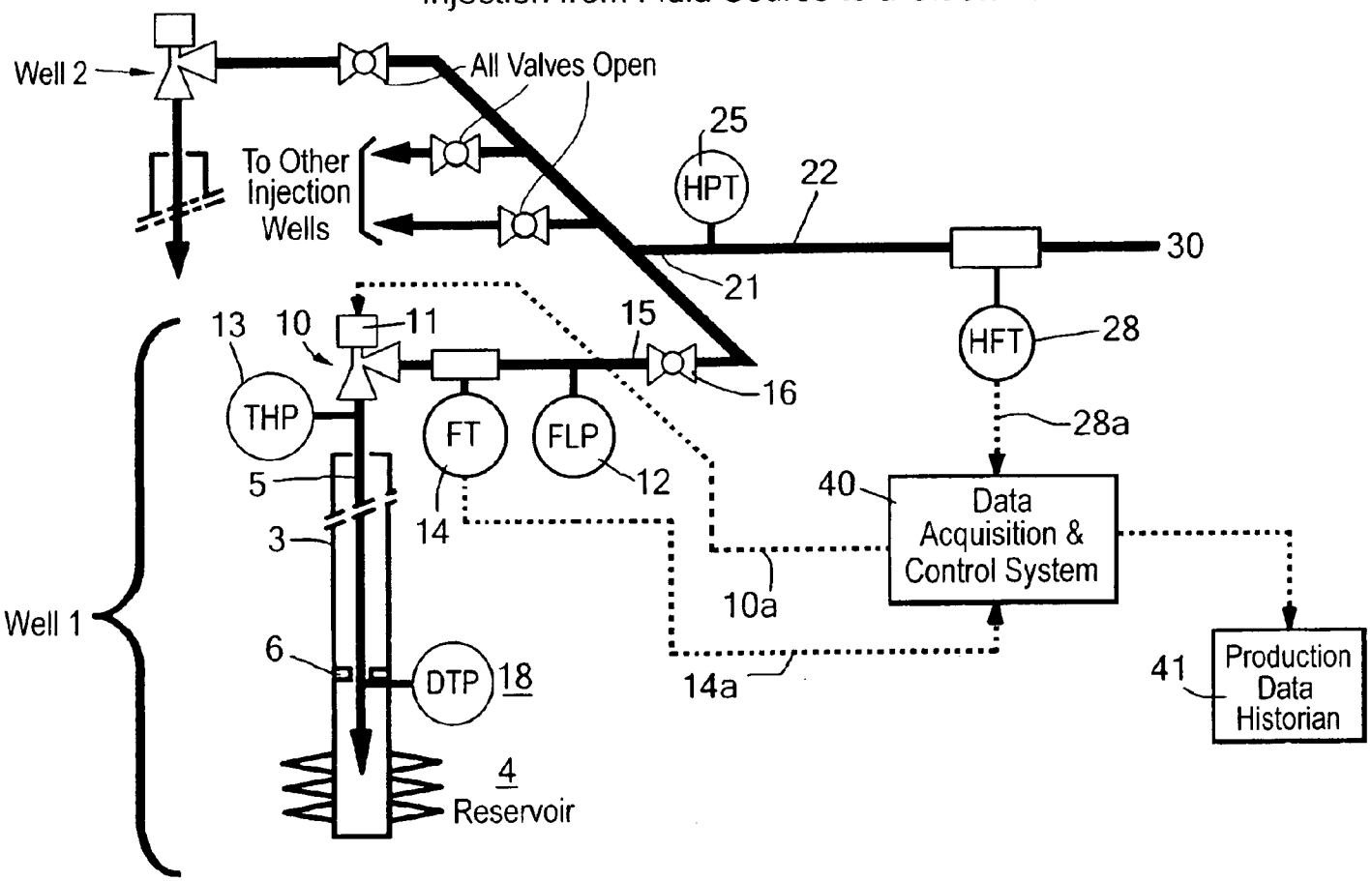
FIG. 1 schematically shows a production system according to the invention in which a fluid is obtained from a fluid source, metered, distributed to a cluster of fluid injection wells, of which two are represented in FIG. 1, and thereafter injected into one or more subsurface reservoirs.

FIG. 1 depicts a fluid injection system comprising a cluster of injection wells which receive the injection fluid from a common source 30 for which a header flow meter 28 measures overall injection flow rate, and a header pressure transmitter 25 measures the fluid supply pressure. The injected fluid may comprise water, steam, natural gas, carbon dioxide, nitrogen, chemical enhanced oil recovery (EOR) agents and/or other fluids.

The fluid is distributed via an injection manifold 21 to the cluster of injection wells, each with an isolation valve 16 on the well flowline 15. Injection well 1 is shown in detail, and may be taken as representative of the other injection wells in the cluster. Well 1 comprises a well casing 3 secured in a borehole in the underground formation 4 and production tubing 5 extending from surface to the wellbore in contact with the underground formation. The flow path in the annulus between the tubing and the casing is blocked by a packer 6. The well 1 further includes a wellhead 10 provided with well variable monitoring equipment for making well variable measurements, typically a THP gauge 13 for measuring Tubing Head Pressure (THP). Optionally, the well monitoring equipment comprises a Flowline Pressure (FLP) gauge 12 for monitoring pressure in the well surface flowline, and an injection fluid flowmeter 14. Optionally, an injection choke valve will be available for regulating the injection flow into the well, and further optionally, a means of controlling the valve automatically via an actuator 11, of which position will be recorded. Optionally, there may be downhole monitoring equipment for making subsurface measurements, for example a Downhole Tubing Pressure (DHP) Gauge 18. The wellheads of the injection wells in a cluster may be located on land or offshore, above the surface of the sea or on the sea bed.

Figure 2:
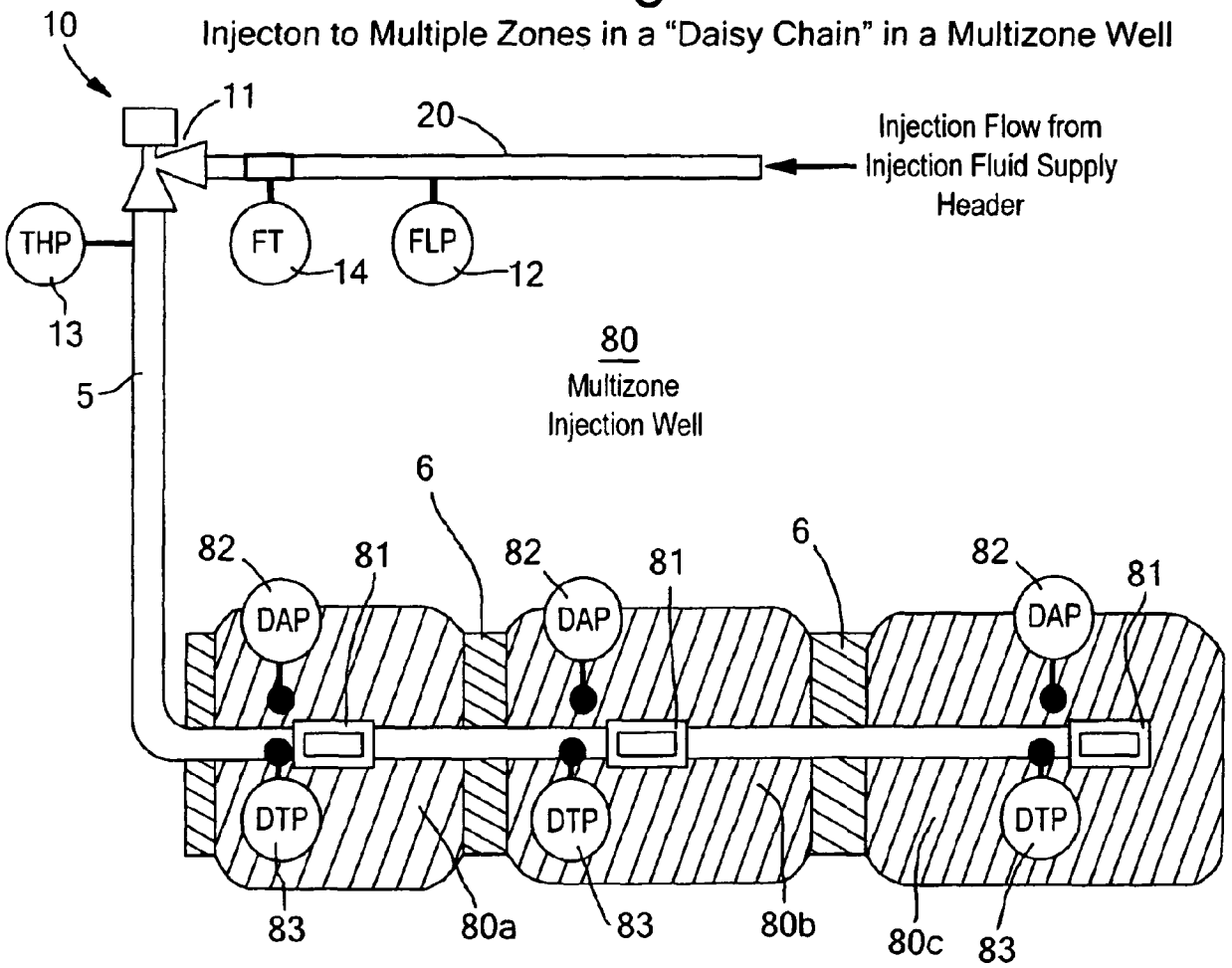
FIG. 2 illustrates a three zone injection well in which the injection zones are all originate from a common tubing with segments that form different inflow regions, the sequential connection between the zones of the well and the shared tubing being termed a "daisy chain".
Figure 3:
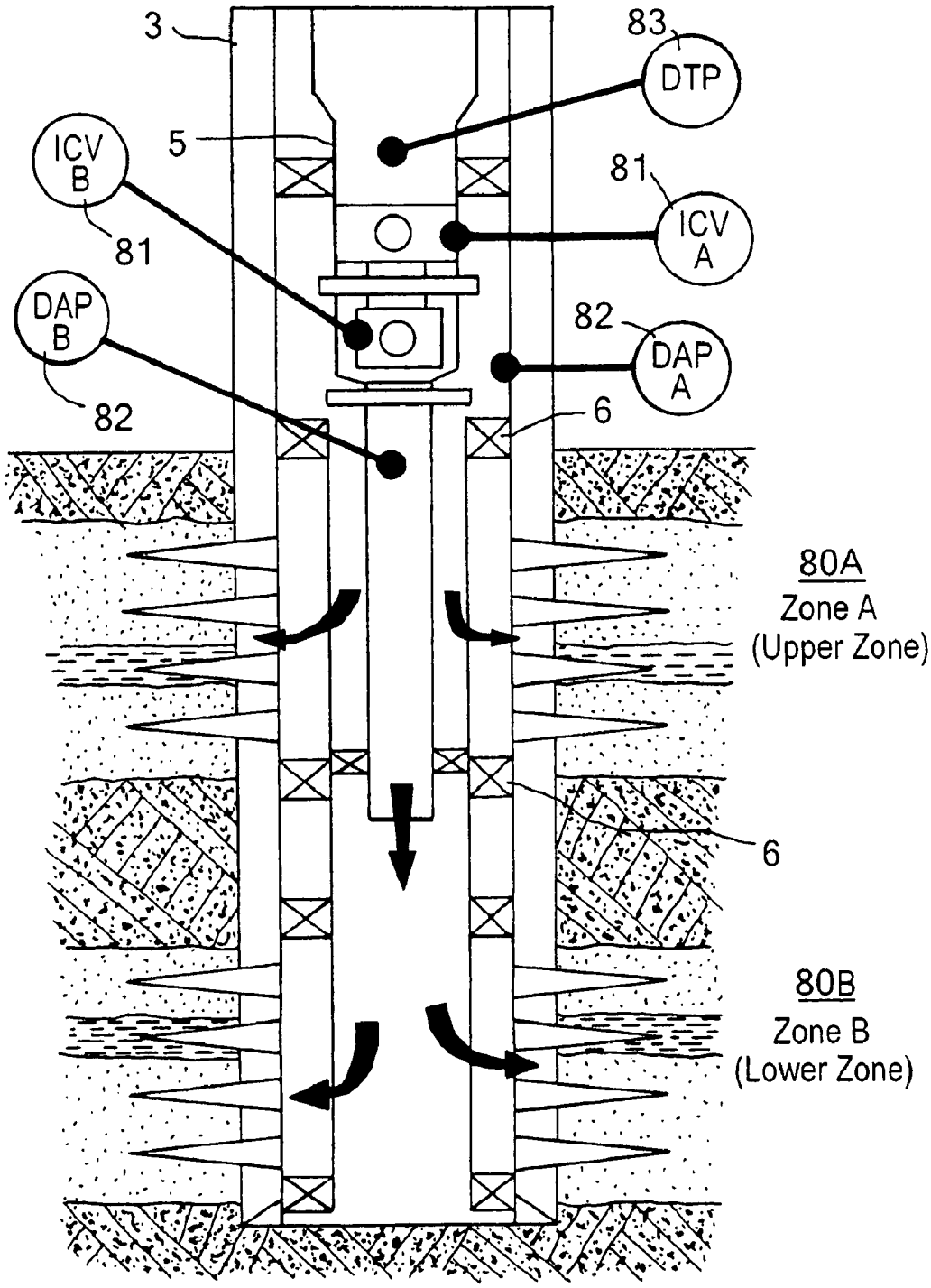
FIG. 3 illustrates a two zone injection well in which the upper and lower injection zones branch from a single point via concentric tubing.

One or more injection wells may also inject into two or more subsurface zones or branches, with subsurface configurations typically as shown FIG. 2 and FIG. 3. FIG. 2 illustrates a multizone fluid injection well 80 with tubing 5 extending to well segments, which form three distinct producing zones 80*a*, 80*b* and 80*c*, separated by packers 6. Each zone has means of measuring the variations of thermodynamic quantities of the fluids within zone as the fluid injection to each zone varies, and these can include one or more downhole tubing pressure gauges 83 and one or more downhole annulus pressure gauges 82. Each zone will have a means for remotely adjusting the injection into the zone from the tubing, for example, an inflow (or interval) control valve (ICV) 81, either on-off or step-by-step variable or continuously variable. The multizone well 80 further includes a wellhead 10 provided with well variable measurement devices, for example, "Tubing Head Pressure" (THP) gauge 13 and "Flowline Pressure" (FLP) gauge 12, with the most upstream downhole tubing pressure gauge corresponding to item 18 in FIG. 1.

FIG. 3 illustrates an optional configuration with a two zone injection well (Zones A and Zone B, separated by packers 6) with tubing 5 branching into to separate concentric flow paths to Zone A and Zone B, controlled via inflow control valves ICV A and ICV B, 81, either on-off or step-by-step variable or continuously variable. Each zone has means of measuring the variations of thermodynamic quantities of the fluids within zone as the fluid injection to each zone varies, and these can include one or more shared downhole tubing pressure gauges 83 and one or more downhole annulus pressure gauges 82 for each zone.

The well measurements comprising at least data from 13, 82 and 83, position of injection choke 11, and optionally from 12, 14 and from other measurement devices, as available, are continuously transmitted to the "Data Acquisition and Control System" 40. Similarly, the injection fluid supply measurements 25, 28 are continuously transmitted to the "Data Acquisition and Control System" 50, in FIG. 1. The typical data transmission paths are illustrated as 14*a* and 28*a*. The data in 40 is stored in the "Production data Historian" 41 and is then subsequently available for non-real time data retrieval for data analysis, model construction and control as outlined in herein.

Figure 4:
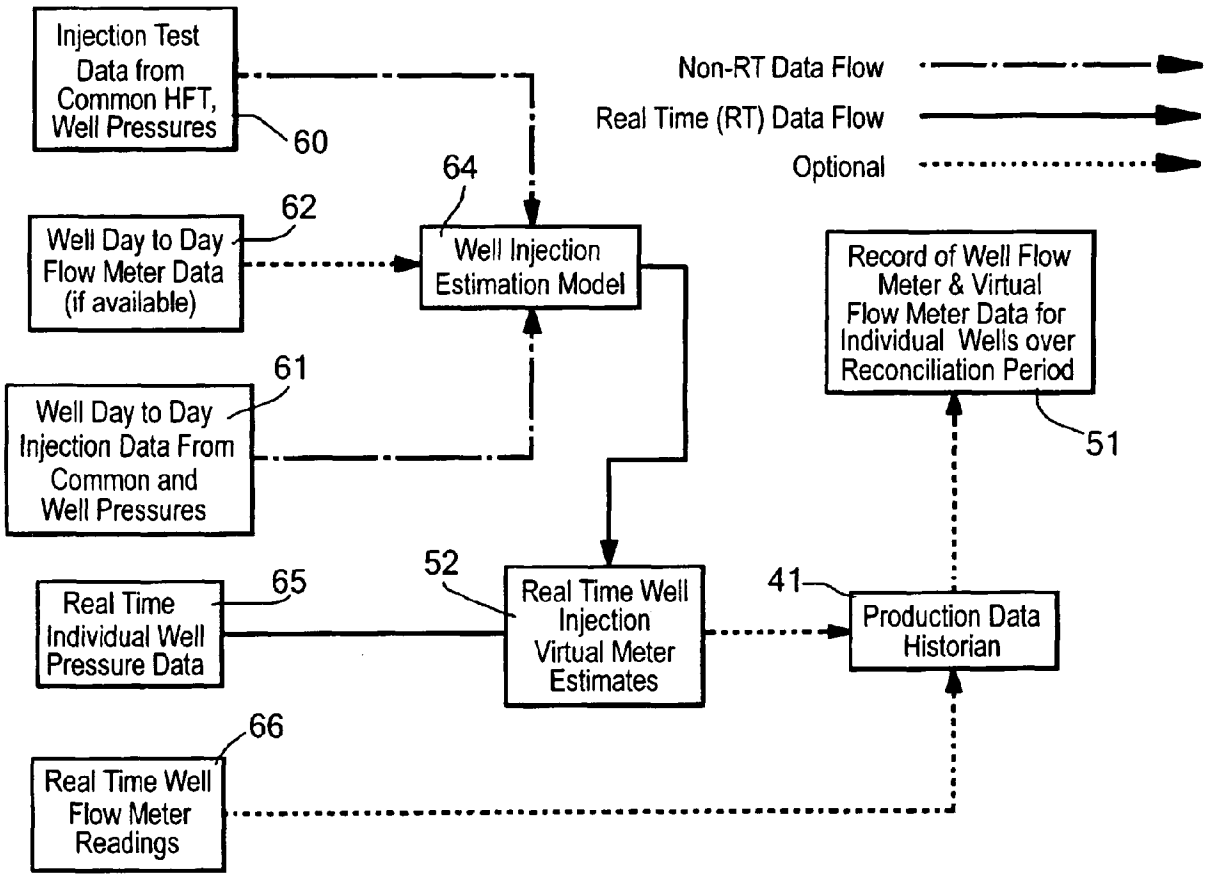
FIG. 4 schematically shows how data from well deliberately disturbed injection testing is used to construct the surface well injection estimation models and how real time estimates are generated.

Reference is now made to FIG. 4, which provides a preferred embodiment of the "PU Inj" modelling process according to this invention. The intent is to generate sustainably useful models fit for the purpose of the invention, taking into account only significant injection system characteristics and effects.

The cluster of injection wells may comprise a number of n wells indexed i=1, 2, . . . , n, and the method may comprise the initial steps of injection testing the wells 60. This is achieved by performing a series of actions during which injection to a tested well is varied by adjusting 11, optionally 16, including closing in the well injection for a period of time, and then injection of the tested well is started up in steps such that the tested well is induced to produce at multiple injection rates over a normal potential injection range of the well, at the same time controlling the other wells in the cluster such as to cause their tubing head pressures or optionally flow meter readings to be approximately constant for the duration of the test. For the duration of time of the test, including the periods immediate before and after the test, the supply flow 28 and pressure 25 and all available measurements at the wells are recorded, which test is hereinafter referred to as a "Deliberately Disturbed Injection Testing" (DDIT). In this test, the injection flow rate through the tested well is inferred by the difference in the header flow between when the well was closed in and the recorded the header flow during the test.

Optionally, if a well has a flowmeter, then the historical information of the variation of flowrate 61 and other measured variables at the well 62 may be used to construct a well injection estimation model.

Further optionally, the common supply pressure, as recorded by 25, may be varied in steps so that the injection rates of the wells are simultaneously varied.

Optionally, if each well has a flowmeter, the common supply pressure, as recorded by 25, may be varied in steps so that the injection rates of the wells are simultaneously varied.

Further optionally, other methods as described in the International Patent application PCT/EP2007/053345 may be used to construct a well injection estimation model. As an example, a sequence of injection well tests may be performed such that sequentially each of the wells of the well cluster is tested for characterization by initially closing in all the wells in the cluster, and subsequently starting up injection to one well at a time, in sequence, with wells individually started up in steps to produce at multiple injection rates over the normal potential operating range of the well, at the same time the supply flow 28 and pressure 25 are recorded. From this sequence of well tests: (i) an estimate of the injection of a first well to be started up is directly obtained from the injection well test of the first well, and the well injection estimation model is calculated for that well, (ii) the injection from the second well to be started-up up is derived from subtracting the injection of the first well using the well model of the first well already established and (iii) the injection and well injection estimation model of the third and any subsequently started well are computed in sequence of their start-ups, thereby obtaining the well injection estimation model of each well of the well cluster.

Given the injection test data 60 as described above, the "well injection estimation model" for each well i is expressed as $\bar{y}_i(t)=\alpha_i+f_i(\beta_i, u_{1i}(t), u_{2i}(t), \ldots)$, wherein the value $\bar{y}_i(t)$ is the estimated injection into well i as monitored throughout the period of time t of the well test, and $u_{1i}(t), u_{2i}(t), \ldots$ are the dynamic measurements at well i that are determined during the well test, including one or more of Items 12, 13, 11, 25 in FIG. 1. The scalar $\alpha_i$ and vector $\beta_i$, with $f_i(\beta_i, \hat{u}_{1i}, \hat{u}_{2i}, \ldots)=0$ for all $\beta_i$ for some nominal set of well operating measurements $\hat{u}_{1i}, \hat{u}_{2i}, \ldots$, are computed to provide a mathematical least squares best fit relating $\bar{y}_i(t)$ and $u_{1i}(t), u_{2i}(t), \ldots$. In this embodiment of the mathematics, $f_i(\beta_i, u_{1i}(t), u_{2i}(t), \ldots)$ can be viewed as the "gain" of the "well production estimation model" about the nominal operating point $\hat{u}_{1i}, \hat{u}_{2i}, \ldots$, and $\alpha_i$ can be viewed as the "bias" or "offset" or "anchor" about that operating point, and the function (al) $f_i(\beta_i, u_{1i}(t), u_{2i}(t), \ldots)$ can be linear or non-linear but in any case parameterised by the vector $\beta_i$;

The "well injection estimation model" 64 is then $\hat{y}_i(t)=\alpha_i+f_i(\beta_i, u_{1i}(t), u_{2i}(t), \ldots)$, where $\hat{y}_i(t)$ is the estimate of injection flow of well i at time t. The model 64 may then be combined with real time values of $u_{1i}(t), u_{2i}(t) \ldots$, item 65 in FIG. 4, to give $\hat{y}_i(t)$, the estimated well injection fluid flow of well i, item 52 in FIG. 4.

Optionally, if the injection well flow meter 14 is operational and providing good estimates, the estimates of injection rate $\bar{y}_i(t)$ may also be replaced by the actual reading of 14, denoted $y_i(t)$ per Item 66 in FIG. 4. In this case, the estimates $\hat{y}_i(t)$ are the backup for the actual injection flow reading $y_i(t)$. The measured $y_i(t)$ and estimated $\hat{y}_i(t)$ injection rates are recorded in the Production Data Historian, 41.

Given injection estimates $\hat{y}_i(t)$, or actual injection flow readings $y_i(t)$ for n wells indexed i=1, 2, . . . , n, the invention provides for improving the individual well injection estimates or injection measurements via a dynamic reconciliation process with the total header measurement FIG. 1, Item 28. This extends the dynamic reconciliation method of PCT/EP2005/055680 to injection wells and to the case where one or more the component measurements is a meter, as opposed to an estimate.

Let the total header measurement FIG. 1, Item 28 be denoted by s(t). In general, due to the topology of flow per FIG. 1, $$s(t) = \sum_{i=1}^{n} \hat{y}_i(t),$$

where for simplicity, $\hat{y}_i(t)$ denotes either the measurement 14 in FIG. 1/66 in FIG. 4, or the virtual meter estimate 52 for the well i. In general, over a time period T, the relation $$s(t) = \sum_{i=1}^{n} \hat{y}_i(t)$$

will not hold due to meter and estimate inaccuracies as well as measurement noise. A dynamic reconciliation process 55 to improve the accuracy of the estimates and to identify estimates which are inaccurate may then be optionally implemented as per FIG. 5. The process works on a pre-determined specified time interval. In that time interval, the models of the estimates are varied in a limited way so that the estimate of total injection $$\sum_{i=1}^{n} \hat{y}_i(t)$$

substantially Matches the measured value s(t) over the entire specified time interval. The process is then repeated in the next time interval.

Figure 5:
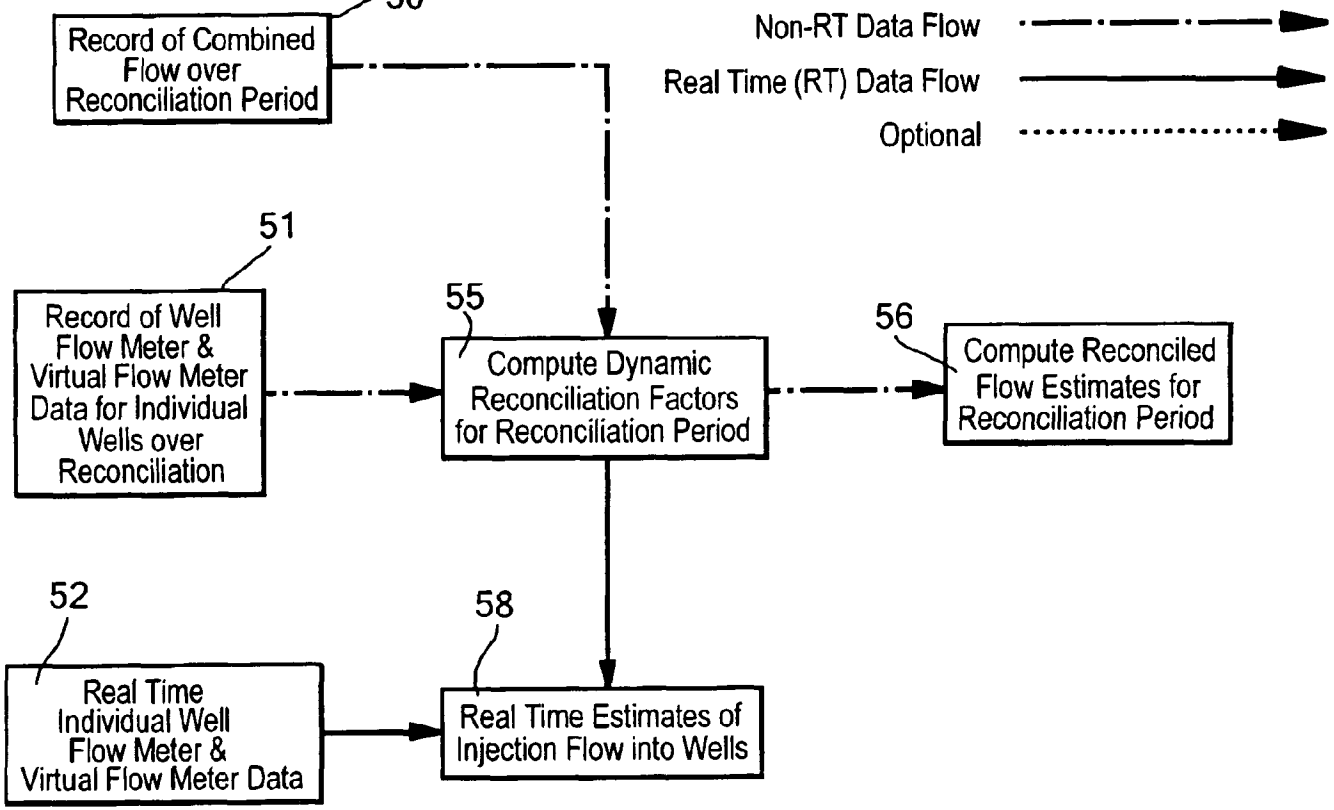
FIG. 5 schematically shows the computation of reconciliation factors for a cluster of injection wells for reconciled estimates, and optionally for the validation of individual well meter readings.

A simple embodiment of the above may assume that $\hat{y}_i(t)$ is related to the true value of flow by $\hat{y}_i=c_iy_i+d_i$, where $y_i$ is the true value, and $c_i, d_i$ are gain error and bias errors. Dynamic reconciliation over a period of time T may then be based on an integrated squared error criterion $$E(T) = \int_T \left[ s(t) - \sum_{i=1}^{n} \hat{y}_i(t) \right]^2 dt = \int_T \left[ s(t) - \sum_{i=1}^{n} (c_i \hat{y}_i(t) + d_i) \right]^2 dt$$

which is to be minimised by appropriate choice of $c_i, d_i$, i=1, 2, . . . , n. In general, it is easy to check the bias terms of the measurement or estimate error, $d_i$, i=1, 2, . . . , n, for example by shutting off flow. Therefore neglecting the $d_i$, i=1, 2, . . . , n terms, the error model then becomes $$E(T) = \int_T \left[ s(t) - \sum_{i=1}^{n} c_i \hat{y}_i(t) \right]^2 dt,$$

which is a conventional least squares form solvable by an expert in the field given discrete samples of s(t) and $\hat{y}_i(t)$ at intervals within T, respectively FIG. 5, Items 50 and 51, to give reconciliation factors $c_i$, i=1, 2, . . . , n. The computed reconciliation factors are then used to compute that best current real time estimate of flow as $c_i\hat{y}_i(t)$, Item 58. Similarly, for the period T, the best estimates of injection flow to the wells are given by $c_i\hat{y}_i(t)$, Item 56.

The computation of the factors $c_i, d_i$, i=1, 2 . . . , n applied to each of the well injection estimation models at each reconciliation computation for a particular reconciliation period may be related further to the factors $c_i, d_i$, i=1, 2, . . . , n from the previous reconciliation period, to reflect a balance between the information available in the previous reconciliation period and the current reconciliation period. To save on the computational memory load, the computation may optionally use the recursive least squares method of, for example, the textbook "Lessons in Digital Estimation Theory", J. M. Mendel, Prentice Hall 1987.

The computation of the factors $c_i, d_i, i=1, 2, \ldots, n$ may also be subjected to additional auxiliary constraints or optimization target terms, such a limitation of $c_i, i=1, 2, \ldots, n$ deviation from 1 to be less than 10%, or minimizing the difference in total volumes $$\Delta(T) = \left( \int_T [s(t)]\, dt - \int_T \left[ \sum_{i=1}^{n} c_i \hat{y}_i(t) \right] dt \right)^2.$$

The foregoing additional auxiliary constraints or optimization targets lead to a problem formulation as a general convex quadratic programme, efficiently solvable using standard numerical iterative optimization tools.

For the wells that have at subsurface (or downhole) level, multiple fluid injection zones or branches with appropriate instrumentation, the invention provides a method for the allocation of injection to the individual zones of the wells and zones and the control of pressures and injection rates to the individual zones. In the sequel the details are illustrated by reference to a multizone well of FIG. 2, but the principles are equally applicable to a multi-branch or a multilateral well.

Figure 6:
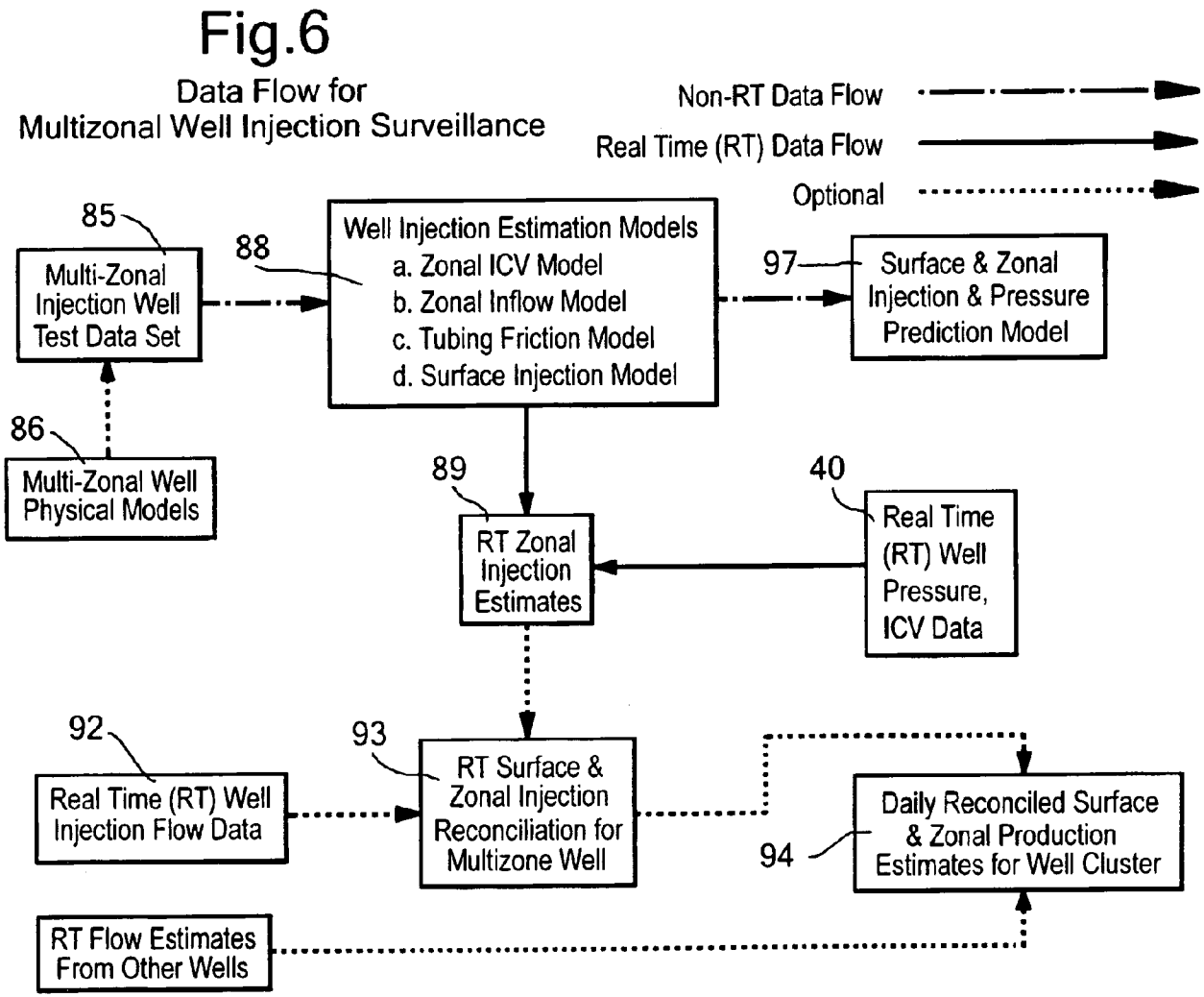
FIG. 6 shows schematically how data from well zonal injection testing is used to construct the well zonal injection estimation models and how real time estimates of injection for individual zones are generated.

With reference to FIG. 6, the procedure leading to the generation of "Surface and Zone Prediction Models" for a multizone injection well with m zones indexed $j=1, 2, \ldots, m$, is described as follows: A "Deliberately Disturbed Multi Zonal Injection Test" (DDMZIT) 85 is conducted during which the injection from each zone is varied by changing the ICV of the zones as well as the surface injection control valve 11. Well surface flow 14 and tubing head pressure 13 measurements are recorded, and optionally measurements 11, 12. Similarly, downhole annulus 82 and tubing 83 pressures and ICV positions 81 are recorded throughout the test. The DDZIT data 85 is used to generate "subsurface models" 88*a, b,c* as well as "surface injection estimation model" 88*d*. The "surface injection estimation model" of a well is of the form $Y=f_s(u_s,v_s,t)$, valid for a range of $u_s, v_s$ within a set of real numbers $U_s \times V_s \times T$, wherein the vector Y is the fluid injection rate of well, $u_s$ is the vector of measurements at the well, $v_s$ is the surface injection control valve position, and t is time. In a preferred embodiment, $u_s$ can be the tubing head pressure 13 and the downhole tubing pressure 18 or alternatively, the tubing head pressure 13 and the flowline pressure 14. The function $f_s$ is constructed using the data from the zonal well test 85 and optionally, from surface well testing as outlined previously.

The zonal well test data 85 is used to generate a set of "subsurface models": (i) "Zonal ICV Models" 88*a*, (ii) the "Zonal Inflow Model" 88*b*, and (iii) "Tubing Friction Models" 88*c*. The "Zonal ICV Models" will be of the form $y_j=k_j(u_j,v_j,t)$, valid for a range of $u_j, v_j, t$ within a set $U_j \times V_j \times T$, wherein $y_j$ is the fluid injection into zone j, $u_j$ is the vector of measurements at zone j, most commonly the annulus and tubing pressure gauges 82 and 83 in FIG. 2, and $v_j$ is the manipulated variable at zone j, the ICV opening.

The "Zonal Inflow Model" will be of the form $y_j=l_j(u_j,p_{Rj},t)$, valid for a range of $u_j, p_{Rj}, t$ within a set $U_j \times P_{Rj} \times T$, wherein $y_j$ is the fluid injection into zone j, $u_j$ is the vector of measurements at zone j, in particular the annulus pressure gauges 82 in FIG. 2, and $p_{Rj}$ is the underlying reservoir pressure for zone j, which is obtained from the downhole annulus pressure 82 after the zone is closed in for a period of time. The zonal inflow $l_j$ characteristic and reservoir pressure $p_{Rj}$ can be expected to decline with time t. Finally, the "Tubing Friction Models" will be of the form $y_{jk}=m_{jk}(u_{jk})$, valid for a range of $u_{jk}$ within a set $U_{jk}$, wherein the vector $y_{jk}$ is the fluid flow between from zone j to zone k, $u_{jk}$ is the vector of measurements at zone j and zone k, in particular the downhole tubing pressure gauges 83 in FIG. 2. The "Tubing Friction Models" 88*c* are required due to the daisy chain configuration of the extended reach wells, and may incorporate pressure differentials due to fluid weights within the tubing arising from differences in vertical elevation. Given the Multizonal Well test data 85, the data driven procedures for constructing the particular "Zonal ICV Models" $y_j=k_j(u_j,v_j,t)$, the "Zonal Inflow Models" $y_j=l_j(u_j,p_{Rj},t)$ and the "Tubing Friction Models" $y_{jk}=m_{jk}(u_{jk})$ is as previously outlined in "PU RTM", "PU DDPT" and "PU RTO".

From the "Zonal ICV Models" 88*a*, and real time subsurface pressure and ICV opening data from the Data Acquisition and Control System 40, real time estimates of the zonal production flows may be estimated 89. The "Zonal Inflow Models" 88*b* may also be used to estimate 89. As the total of the zonal injections should equal the surface injection, the zonal injection estimates may be dynamically reconciled with the surface injection measurement 14 over a period of time, using the methods previously outlined herein to obtain the daily reconciled zonal injection estimates 93.

Similarly, the injection estimate from the multizone extended reach well can be combined with estimated productions from the other wells in the cluster 92, and reconciled with the overall well cluster injection header flow measurements 28 in FIG. 1, to give item 94 in FIG. 6.

Given surface and subsurface models, $Y=f_s(u_s,v_s,t)$, $y_j=k_j(u_j,v_j,t)$, $y_j=l_j(u_j,p_{Rj},t)$, $y_{jk}=m_{jk}(u_{jk})$, $j,k=1, 2, \ldots, m$, and boundary conditions of zonal reservoir pressures $p_{Rj}$, time t, flowline pressure 12, and the relation $Y=\Sigma_{i=1}^{n} y_i$, it should be clear to an expert in the field that the resulting system of equations is similar to a network problem with pressure measurements at its nodes, and is solvable for both the flows and pressures $Y, y_j, u_j$ $j=1, 2, \ldots, m$, for given combinations of $v_s, v_j, j=1, 2, \ldots, m$. Hence the relations above constitute the "Surface and Zonal Injection and Pressure Prediction Model" 97, of FIG. 4. Optionally, the difference form of the relations of 97 may be used: $\Delta Y=\hat{f}_{s,u_s,v_s}(\Delta u_s,\Delta v_s)$, $\Delta Y=\Sigma_{j=1}^{m}\Delta y_j$, $\Delta y_j=\hat{k}_{j,u_j,v_j}(\Delta u_j,\Delta v_j)$, $\Delta y_j=\hat{l}_{j,u_j}(\Delta u_j)$, $\Delta y_{jk}=\hat{m}_{jk,u_{jk}}(\Delta u_{jk})$, $j,k=1, 2, \ldots, m$, where $\Delta Y$ denotes differential changes to Y, and $\hat{f}_{s,u_s,v_s}$ denotes the first order approximation of $f_s$ with respect to the differenced variables at $u_s, v_s$, and so on. The differenced form is useful as it is even more easily solvable and allows consideration of changes only as a result of changes in the manipulated variables, and the results of the computation to be consistent with the current state of the multizone well as measured in real time in terms of the measured downhole and surface pressures, $u_s, u_j, j=1, 2, \ldots, n$.

Figure 7:
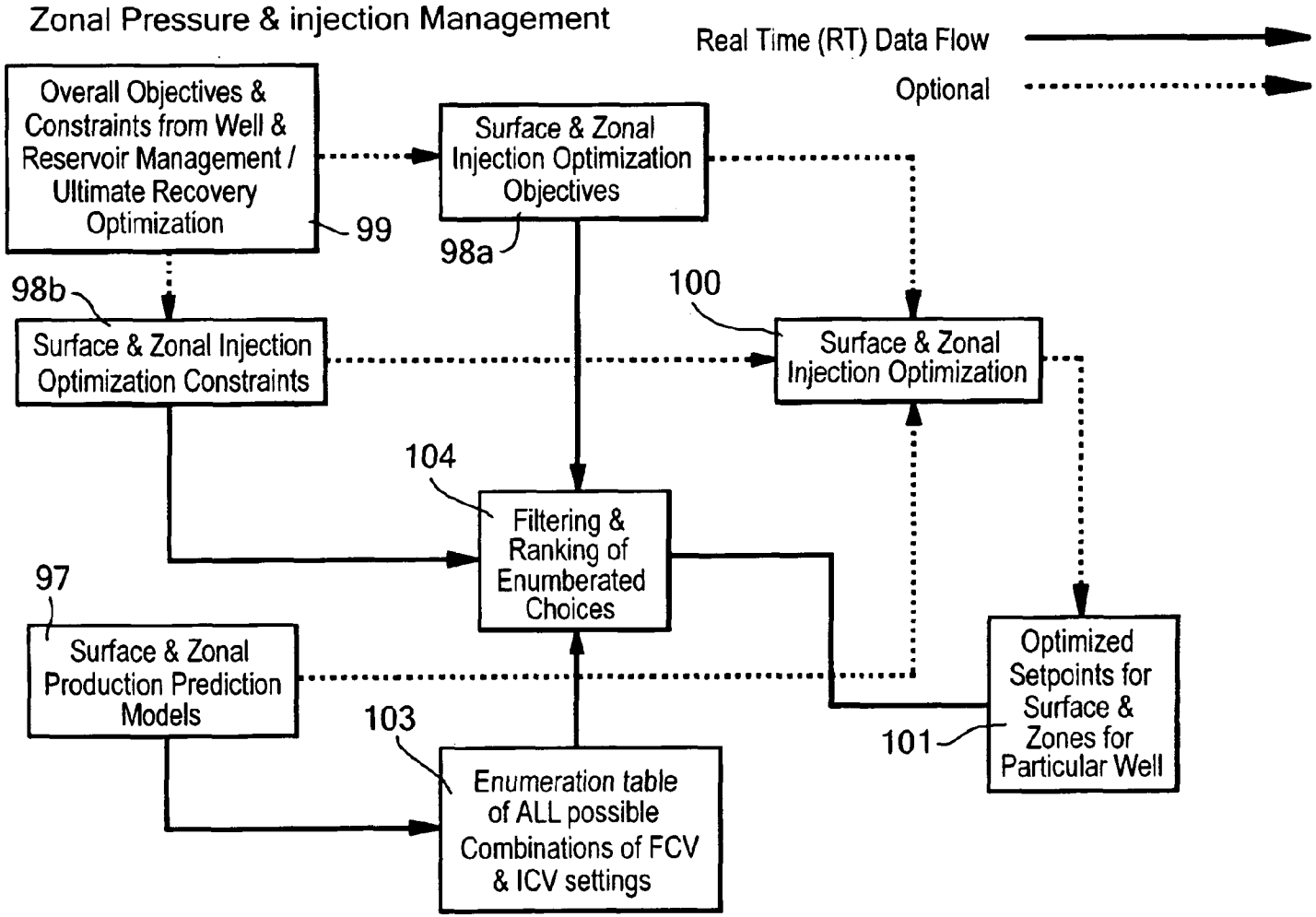
FIG. 7 shows the steps in the use of the data to generate setpoints for the surface injection control and the subsurface ICV settings to control injection rates and pressures at each zone.

Once the "Surface and Zonal Injection and Pressure Prediction Model" 97 is available, the control of the well injection and pressures is implemented as per the workflow in FIG. 7. If the required surface and ICV control setpoints $v_s, v_i, j=1, 2, \ldots, m$ were continuously variable based on the desired zonal and surface production and pressure levels, then $v_s, v_i$, $j=1, 2, \ldots, m$ can be computed using an continuous optimization framework 100 as follows:

$$\max_{v_s, v_j} R(Y, u_s, v_s, y_j, u_j, v_j, j = 1, 2, \ldots, m)$$

subject to K constraints $c_k(Y,u_s,v_s,y_j,u_j,v_j, j=1, 2, \ldots, m) \geqq 0$, $k=1, 2, \ldots, K$.

where R is the objective function 98*a* for the injection well to be maximized by varying $v_s, v_i, j=1, 2, \ldots, m$, the manipulated variables at well and its zones, subject to K constraints 98*b* on $Y, u_s, v_s, y_j, u_j, v_j, j=1, 2, \ldots, m$, the well and zone injection, the well and zone measured variables and the well and zone manipulated variables, respectively. The optimization objectives and constraints may come from an overall field or reservoir management plan 99.

However, it is currently the state of the art that the subsurface ICV positions, $v_j, j=1, 2, \ldots, m$, can only vary a limited number of positions, say, N. The surface injection control may also by restricted to the same number of positions. Hence, since the number of zones per extended reach injection well is limited to date to $n \leqq 4$, there are only $N^{m+1}$ possible combinations for $v_s, v_j, j=1, 2, \ldots, m$, and it is the preferred approach to enumerate the entire range of possibilities to produce an Enumeration Table 103. Given the enumeration based on the $N^{m+1}$ possible combinations for $v_s, v_j$, $j=1, 2, \ldots, m$, and the surface and zonal injection and pressure prediction model 97, it is straight forward to filter the table 103 as per the constraints 98*b* and rank the remaining alternatives using the objective function 98*a*. The best set of setpoints for $v_s, v_j, j=1, 2, \ldots, m$ is therefore computed 101.

The set of "optimised setpoints" is then available for further action. Reference may be made to the Applicant's International Patent Application PCT/EP2007/053348, for a variety of possible actions to suit operational requirements following the computation of the setpoints.

What is claimed is:

1. A method for determining fluid flow rates in a cluster of fluid injection wells which are connected to a collective fluid supply header conduit assembly, the method comprising:

a) monitoring fluid flow, and optionally pressure, in the collective injection fluid supply header conduit assembly by means of a header flow meter, and optionally a header pressure gauge;

b) monitoring one or more injection well variables in or near each injection well by means of well variable monitoring equipment arranged in or near each injection well, including a tubing head pressure gauge in a fluid injection tubing in or near each injection well, and optionally a surface or downhole flow meter, an injection choke valve position indicator, a differential pressure gauge across a flow restriction, a wellhead flow line pressure gauge and/or a downhole tubing pressure gauge;

c) sequentially testing each of the injection wells of the cluster by performing a dynamically disturbed injection well test on the tested well, during which test the well is first closed and is then gradually opened in a sequence of steps so that the injection rate to the tested well is varied over a range of flows whilst the fluid flow rate and optionally pressure in the header conduit assembly are monitored in accordance with step a and one or more injection well variables of the well under test and of the other wells in the cluster are monitored in accordance with step b, and controlling the other wells in the cluster such as to cause their tubing head pressures or flow meter readings to be substantially constant for the duration of the test;

d) deriving from step c a well injection estimation model for each tested well, which model provides a correlation between variations of the fluid flow rate attributable to the well under consideration, and optionally pressure, in the header conduit assembly measured in accordance with step a, and variations of one or more well variables monitored in accordance with step b during each dynamically disturbed injection well test;

e) injecting fluid through the header conduit assembly into the cluster of wells whilst a dynamic fluid flow pattern, and optionally a dynamic pressure pattern, in the header conduit assembly is monitored in accordance with step a and one or more well variables of each injection well are monitored in accordance with step b;

f) calculating an estimated injection rate at each well on the basis of the well variables monitored in accordance with step e and the well injection estimation model derived in accordance with step d; and wherein the method further includes a dynamic reconciliation process comprising the steps of:

g) calculating an estimated dynamic flow pattern in the supply header conduit assembly over a selected period of time by accumulating the estimated injection flows of each of the wells made in accordance with step f over the selected period of time;

h) iteratively adjusting for each injection well the well injection estimation model for that well until across the selected period of time the accumulated estimated dynamic flow pattern calculated in accordance with step g substantially matches with the monitored header dynamic fluid flow pattern monitored in accordance with step e; and i) repeating steps g and h from time to time.

2. The method of claim 1, wherein the well variable monitoring equipment either does not comprise surface or downhole flow meters or comprises one or more defective or inaccurate surface or downhole flow meters, at one or more injection wells and wherein a virtual flow meter is generated in step f and then refined via the dynamic reconciliation process.

3. The method of claim 1 wherein at least one injection well is a multi-zone injection well with multiple zones and/or branches that are each connected to a main wellbore at a zonal or branch connection point which is provided with an Inflow Control Valve (ICV), means for estimating the current position of the ICV, and one or more downhole pressure gauges located upstream and/or downstream of the ICV for monitoring the fluid pressure upstream and/or downstream of the ICV, and the method further comprises:

j) performing a deliberately disturbed zonal injection test during which the flow rate of the fluid injected into each zone of the tested multi-zone well is varied by sequentially changing the opening of each ICV;

k) monitoring during step j injection well variables including the surface flow rate and pressure of the fluid injected into the tested multi-zone well, the position of each ICV and the fluid pressure upstream and/or downstream of each ICV;

l) deriving from steps j and k a zonal injection estimation model for each of the tested zones, which model provides a correlation between the monitored injection well variables and an associated fluid injection rate into each of the zones of the multi-zone well;

m) calculating an estimated injection rate at each zone on the basis of the surface and zonal variables monitored in accordance with step k and the zonal injection estimation model derived in accordance with step l; and n) repeating steps j, k, l and m from time to time.

4. The method of claim 3, wherein the method further includes a dynamic reconciliation process comprising the steps of:

o) calculating an estimated dynamic flow pattern in the surface wellhead of any of the multi-zone wells over a selected period of time by accumulating the estimated injection flows of each of the well zones made in accordance with step m over the selected period of time; and p) iteratively adjusting for each injection well zone the well injection estimation model for that well zone until across the selected period of time the accumulated estimated dynamic flow pattern calculated in accordance with step n substantially matches with a monitored surface wellhead dynamic fluid flow pattern; and q) repeating steps o and p from time to time.

5. The method of claim 4, wherein step p is performed with an estimated surface wellhead fluid flow pattern computed from step e and reconciled with the monitored surface wellhead dynamic fluid flow pattern.

6. The method of claim 3 wherein:

r) an operational injection target is defined for each of the zones, consisting of a target to be optimized and various constraints on the zonal injection flows and well bore pressures or other variables measured in step k; and s) from the estimates of step m or step p, adjustments to settings of zonal ICVs are made such that the optimization target of step r is approached.

7. The method of claim 3, wherein the step of monitoring injection variables further includes:

monitoring the position of one or more flow or pressure control valves and/or the performance of one or more fluid injection pumps and an associated regulatory control mechanism at the earth surface;

monitoring the temperature, composition and/or other physical properties of the injected fluid downhole or at the earth surface by other types of gauges such as a temperature gauge and/or acoustic devices; and/or virtual metering of fluid injection into each zone by a virtual flow meter which monitors a pressure difference $\Delta p$ across each ICV and calculates a fluid velocity v in a smallest cross-sectional flow area of each ICV using the formula $\Delta p = \frac{1}{2}\rho \cdot v^2$, wherein $\rho$ is the density of the injected fluid flowing through the ICV and v is the fluid velocity through the ICV, and which calculates the flow rate by multiplying the calculated fluid velocity by the smallest cross-sectional flow area of the ICV.

8. The method of claim 6, wherein during each repetition of step m a well and zonal injection and pressure prediction model for the multi-zone well system is derived, which model provides a correlation between the position of each ICV and the surface pressure, and the associated fluid injection rate and pressures at each of the zones of the multi-zone well; and ICV settings corresponding to the requirements of step s are computed using the well and zonal injection and pressure prediction model computed, and optionally, additionally on the basis of the surface and zonal variables monitored in accordance with step k, using a differenced form of the well and zonal injection and pressure prediction model.

9. The method of claim 1, wherein step c comprises testing sequentially one or more of the injection wells of the cluster by closing in all other injection wells, and performing a dynamically disturbed injection well test on the tested well, during which test the injection rate to the tested well is varied over a range of flows whilst the fluid flow rate and pressure in the header conduit assembly are monitored in accordance with step a and one or more injection well variables of the well under test are monitored in accordance with step b.

10. The method of claim 1, wherein the dynamic reconciliation process further comprises making reconciliation adjustments to the well injection estimation models, which adjustments are related further to the previous reconciliation adjustments to the well injection estimation models to reflect a balance between the information available in the previous reconciliation period and the current reconciliation period.

11. The method of claim 1 wherein the dynamic reconciliation process further comprises computing additive and multiplicative quantities applied to each of the well injection estimation models.

12. The method of claim 11, wherein the computation uses a least squares method, or optionally a recursive least squares method, or optionally generalizations thereof with additional auxiliary constraints and targets leading to solution via convex quadratic program.

13. The method of claim 1, wherein the injected fluid comprises any combination of the following: water, steam, carbon dioxide, nitrogen methane and chemical enhanced oil recovery compositions.

14. The method of claim 6, wherein the step of defining an operational injection target further includes reflecting in the operational injection target and constraints derived quantities such as preference of nearly equal pressures downstream of the ICVs for all zones and or maximum allowable pressure downstream of the ICVs.

15. The method of claim 6, wherein the step of computing from the model of step l, ICV settings to be adjusted further includes computing adjustments to settings of a surface flow or pressure control valve or pump such that the optimization target is approached.

* * * * *